US006478208B2

(12) United States Patent
Büchel et al.

(10) Patent No.: US 6,478,208 B2
(45) Date of Patent: Nov. 12, 2002

(54) HOLDER FOR A DRIVE PISTON OF A SETTING TOOL

(75) Inventors: Franz Büchel, Ruggell (LI); Thomas Sperrfechter, Zizers (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/071,694

(22) Filed: Feb. 8, 2002

(65) Prior Publication Data

US 2002/0108988 A1 Aug. 15, 2002

(30) Foreign Application Priority Data

Feb. 9, 2001 (DE) ..... 101 05 879

(51) Int. Cl.[7] ..... B25C 1/14
(52) U.S. Cl. ..... 227/10; 173/211
(58) Field of Search ..... 227/9, 10, 11, 227/130; 173/210, 211

(56) References Cited

U.S. PATENT DOCUMENTS

| | | | | |
|---|---|---|---|---|
| 4,162,033 A | | 7/1979 | Pomeroy | |
| 4,867,365 A | * | 9/1989 | Buechel et al. | 227/9 |
| 4,941,391 A | * | 7/1990 | Ehmig et al. | 227/10 |
| 5,538,172 A | * | 7/1996 | Jochum et al. | 227/130 |
| 5,797,534 A | * | 8/1998 | Almeras et al. | 227/10 |
| 5,881,940 A | * | 3/1999 | Almeras et al. | 227/10 |
| 6,092,710 A | * | 7/2000 | Kersten | 173/211 |
| 6,123,243 A | * | 9/2000 | Pfister et al. | 227/10 |

FOREIGN PATENT DOCUMENTS

| | | |
|---|---|---|
| EP | 0346275 | 1/1992 |

* cited by examiner

*Primary Examiner*—Scott A. Smith
(74) *Attorney, Agent, or Firm*—Sidley Austin Brown & Wood, LLP

(57) ABSTRACT

A piston holder for a drive piston (8) of a setting tool and having a carrier (7) for two expansion legs (22, 23) for frictionally receiving the drive piston (8) therebetween, with the carrier (7) being fixedly secured in the setting tool.

4 Claims, 2 Drawing Sheets

HOLDER FOR A DRIVE PISTON OF A SETTING TOOL

BACKGROUND OF THE INVENTION

1. Field of the Invention

The present invention relates to a holder for a drive piston of a setting tool.

2. Description of the Prior Art

European Publication EP-O 346275 B1 discloses an explosive powder charge-operated setting tool including a piston guide and a drive piston displaceable in the piston guide. The piston guide has radial openings facing the drive piston, and spring-biased braking balls engaging the drive piston. The spring, which applies a biasing force to the braking balls is formed as a ring spring for applying a radially acting, with respect to the piston, biasing force to the braking balls. The ring spring is provided on its inner profile with a bearing surface acting on the braking ball. The bearing surface is inclined to the piston at an acute angle that opens in a direction opposite a setting direction. In the ignition ready position of the drive piston, the braking balls engage the outer surface of the drive piston under the action of the ring spring. When the drive piston moves in the setting direction, it entrains the braking balls therewith. The braking balls expand the ring spring, which results in the bearing surface transmitting the radial biasing force to the braking balls in the direction toward the drive piston. The braking balls are pressed radially against the piston body by the ring spring. Even with a small displacement of the drive piston in a direction opposite the setting direction, the braking effect can be substantially reduced or eliminated, as the braking balls displace in the same direction as the drive piston, unloading the ring spring. After being unloaded, the spring washer does not press any more the braking balls against the piston body. Further, a possibility still remains that the drive piston would be displaced, before ignition or firing of the setting tool, in the setting direction as a result of, e.g., the setting tool being pressed too hard against a constructional component. The displacement in the return direction is effected due to cooperation of the spring washer with the braking balls.

U.S. Pat. No. 4,162,033 discloses a setting tool with a braking element that continuously applies a braking force to the drive piston.

An object of the present invention is to provide a piston holder having a simplified design and which would reliably retain the drive piston in its ignition-ready position in the absence of ignition.

SUMMARY OF THE INVENTION

This and other objects of the present invention, which will become apparent herein after, are achieved by providing a piston holder for a drive piston of a setting tool and including a support or a carrier for two expansion legs for frictionally receiving the drive piston therebetween, which carrier is fixedly secured in the setting tool.

The two expansion legs extend at an acute angle to each other and are resiliently deflectable relative to each other, forming together a resilient clamping device. The expansion legs overlap the drive piston in such a way that the inner edges of the two expansion legs apply pressure to approximately diametrically opposite circumferential sections of the drive piston. Advantageously, the two expansion legs lie in a plane that forms with the axial or drive-out direction of the drive piston an acute angle opening toward the front end of the setting tool.

When the drive piston moves in the setting, drive-out direction, i.e., toward the front end of the setting tool, the friction force, which is applied by the expansion legs to the drive piston or to its body, increases. With increase of the displacement path of the drive piston, a holding or braking force acting on the drive piston also increases due to the increase of the wedge action between the expansion legs and the drive piston. However, when the drive piston-displacing force exceeds a predetermined value, the expansion legs elastically expand, releasing the drive piston. In this way, the expansion legs act as a quasi overload protection means. Upon its release, the drive piston just slides through the guide channel and drives an object, e.g., a fastening element in, e.g., a constructional component. In this way, practically, there is obtained a speed-dependent friction coefficient that provides for reduction of friction at a high relative speed between the drive piston and the expansion legs. A total braking or a complete stop in this way is prevented.

The expansion legs do not hinder return movement of the drive piston when it returns to its initial, ignition-ready position after the completion of a drive-in or setting process, as the friction between the drive piston and the expansion legs is still very small.

Due to the prestress of the expansion legs relative to each other, a small pressure is constantly applied to the drive piston or its body. Thereby, the drive piston is reliably held in its ignition-ready position in the absence of ignition of the setting tool. If an undesirable displacement of the drive piston takes place as a result, e.g., of the setting tool being pressed too hard against a constructional component, the expansion legs would become loaded in the drive piston drive-out direction, whereby a restoring force is generated that provides for displacement of the drive piston into its initial position. The piston holder simultaneously provides for reduction of undesirable rebounds of the drive piston.

Generally, both expansion legs can be formed as separate parts securable on their carrier. However, according to an advantageous embodiment of the present invention, the expansion legs form legs of a V-shaped spring, forming parts of a one-piece element. Forming the expansion legs as the legs of a V-shaped spring facilitates their mounting and reduces manufacturing costs of the piston holder. The spring can be wound with its other end about a bolt secured in the carrier. This provides for preloading of the spring in the direction opposite the setting direction. Because of such preloading of the V-shaped spring, the expansion legs cannot rotate in the direction opposite the setting direction. For preventing the rotation of the expansion legs in the direction opposite the setting direction, also a suitable stop can be provided.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments when read with reference to the accompanying drawings.

DETAILED DESCRIPTION OF THE PREFERRED EMBODIMENT

Figure 1:
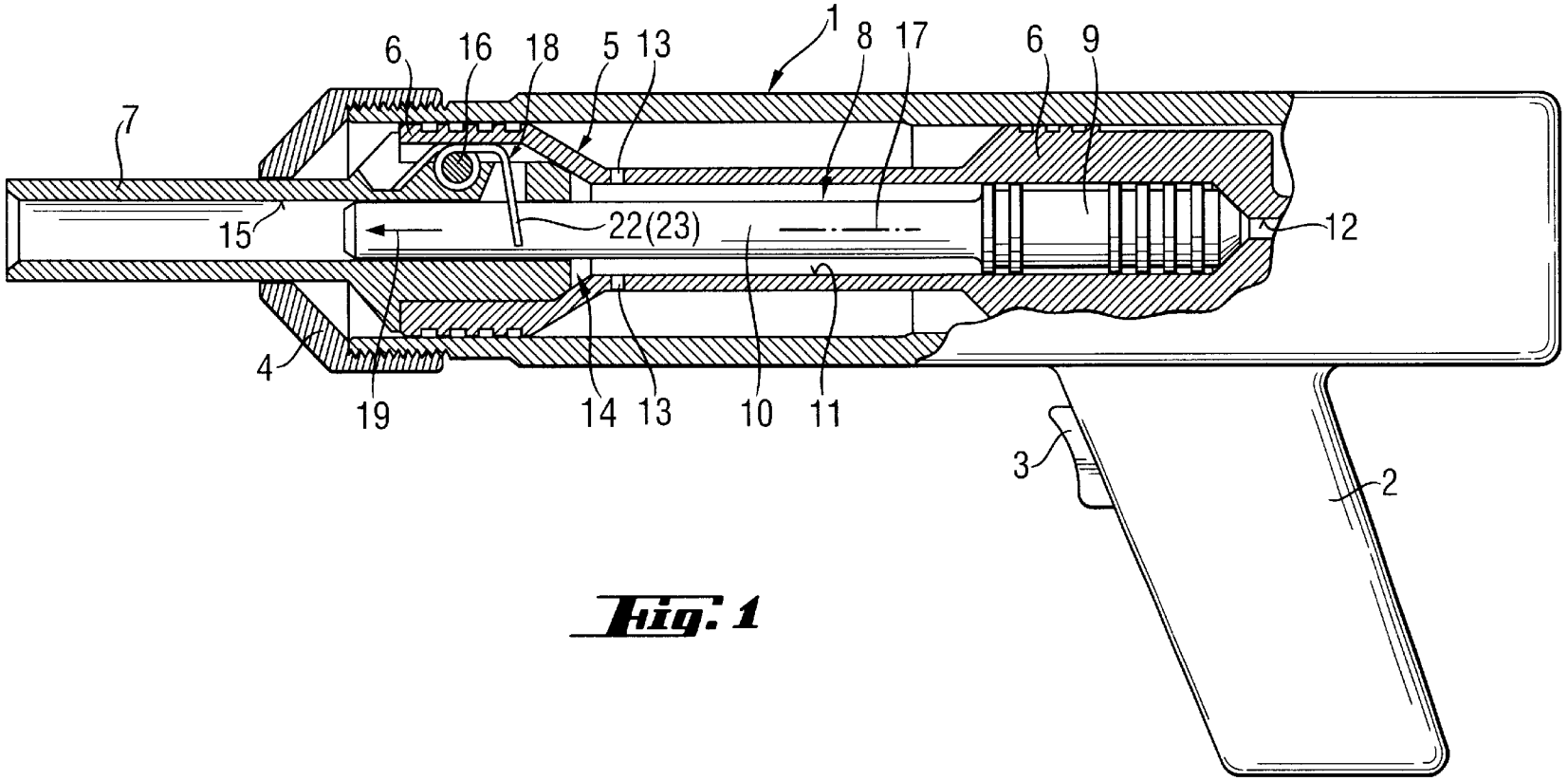
FIG. 1 a partially cross-sectional side view of a setting tool that can be equipped with a piston holder according to the present invention.

A piston holder according to the present invention can be used with a setting tool a partially cross-sectional view of which a shown in FIG. 1. The setting tool, which is shown in FIG. 1, is an explosive power charge-operated tool. However, the inventive piston holder can also be used in a setting tool driven upon ignition of an air-fuel mixture.

The setting tool, which is shown in FIG. 1, has a housing 1 with a handle 2 and a trigger 3 which, in the embodiment shown in FIG. 1, is provided in the handle. A stop socket 4 is screwed to the housing 1 at the housing end facing in the setting direction of the setting tool. A two-part piston guide 5 is displaceably arranged in the housing 1. The piston guide 5 is formed of rear and front parts 6 and 7, respectively. A drive piston 8 is arranged in the piston guide 5. The drive piston 8 has its head 9 displaceable in the rear part 6 and its body 10 displaceable in the front part 7. An inflow channel 12 for explosion gas of an explosive power charge opens into guide bore 11 of the part 6 at the rear end of the bore 11. At its front end, the part 6 has breakthroughs 13 for releasing air, which is accumulated in front of the piston head 9 of the piston 8 in the piston drive-out or setting direction. The front end region of the rear part 6 concentrically overlaps the rear region of the front part 7. The front part 7 extends beyond the stop socket 4 in the setting direction and forms a delivery tube. The rear end of the front part 7 can extend in form of a tubular projection into the guide bore 11, forming a stop limiting the travel of the drive piston 8.

The piston holder according to present invention can be located in a receiving region 14 which is formed in the connection region of the front and rear parts 6, 7.

Figure 3:
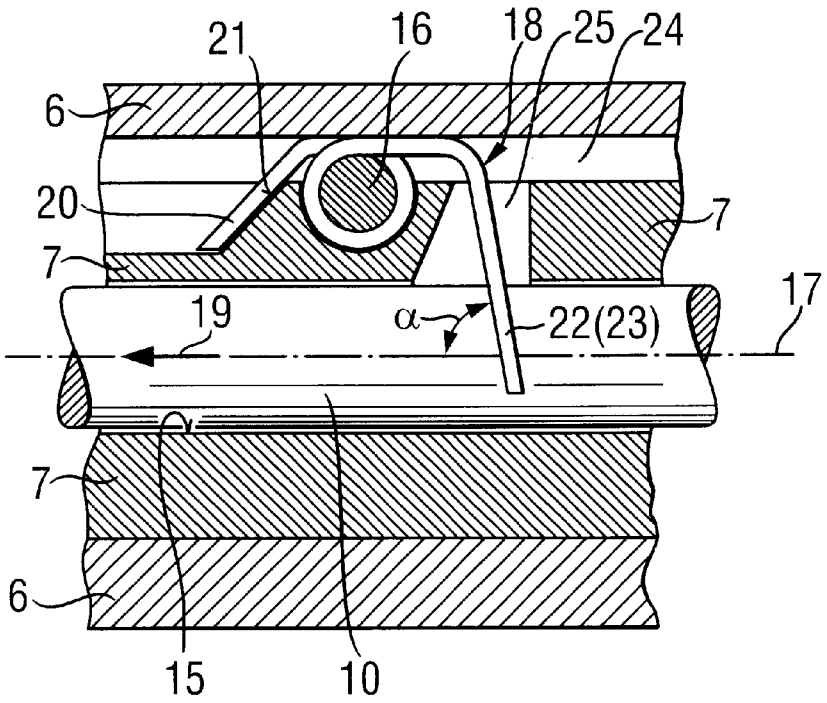
FIG. 3 a partial axial cross-sectional view in the region of the front end of the drive piston.
Figure 2:
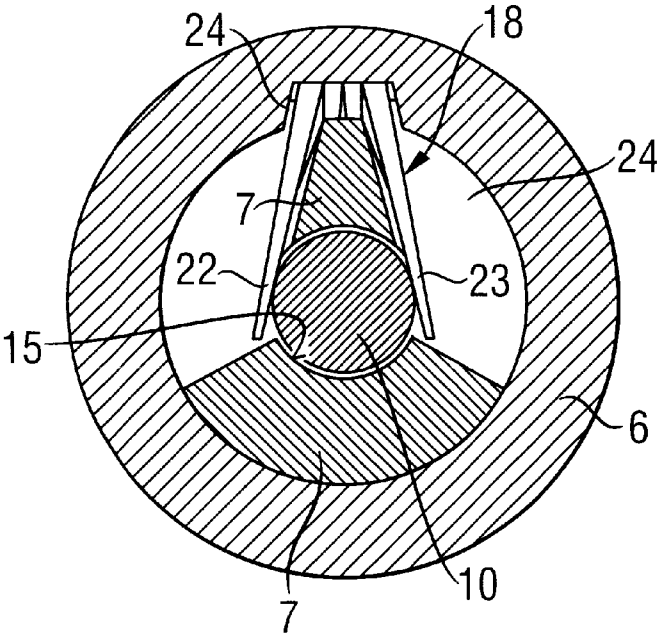
FIG. 2 a cross-sectional view of the setting tool shown in FIG. 1 in the region of the front end of the drive piston.

A first embodiment of a piston holder according to the present invention is shown in FIGS. 2–3 which, as discussed, show radial and axial cross-sections of the front region of the setting tool shown in FIG. 1.

The piston body 10 is guided in the guide channel 15 formed in the front part 7 of the piston guide 5. At the rear end of the front part 7, there is secured a bolt 16 that extends transverse to the axial direction 17 of the guide channel 15. A leaf spring 18 is wound about the bolt 16. An end 20 of the spring 18, which faces in the drive piston drive-out direction 19, setting direction, is supported at a shoulder 21 provided in the front part 7. The other end of the leaf spring 18, remote from the front end of the setting tool, passes in two expansion legs 22, 23 that form with each other a V-shaped profile. The expansion legs 22, 23 extend a short distance in the direction toward the rear end of the setting tool and then extend at an obtuse angle in a direction toward the piston body 10 and apply pressure with their respective inner edges to respective circumferential sections of the piston body 10. The expansion legs 22, 23 lie in a plane that forms an acute angle $\alpha$ with the drive-out direction of the drive piston 8, opening toward the front end of the tool. The sections of the expansion legs 22, 23, which extend parallel to the axial direction 17 of the drive piston 8, are received in a longitudinal groove 24 formed in the inner surface of the rear part 6, and the sections of the expansion legs 22, 23, which extend toward the piston body 10, extend through an opening 25 formed in the front part 7. The spring 18 can also be so formed that after the spring 18 being wound about the bolt 16, the expansion legs 22, 23 are sidewise wound about the spring front end 20.

Generally, the above-mentioned bolt 16 is not absolutely necessary. Rather, the spring 18 can be formed as a cantilevered spring. When the drive piston 8 with its body 10 is displaced in its drive-out direction, the expansion legs 22, 23, because of friction between the legs 22, 23 and the piston body 10, will be rotated, in FIG. 3, clockwise, with the front spring end 20 being supported against the inner surface of the rear part 6. When no explosive force acts on the drive piston 8, the spring 18 brings, with its expansion legs 22, 23, the drive piston 8 in its initial, ignition-ready position, as the expansion legs 22, 23 would rotate counterclockwise, becoming loose.

However, when the drive piston 8 moves, upon application of the explosive force, further in its drive-out direction, the legs 22, 23 elastically expand when the friction between the legs 22, 23 and the piston body 10, is overcome, releasing the drive piston 8 that now can slide through between the legs. The expansion legs 22, 23 of the spring 18 do not hinder in any substantial manner the return movement of the drive piston 8 as the friction between the drive piston 8 and the legs 22, 23 is substantially reduced.

Though the present invention was shown and described with references to the preferred embodiment, such is merely illustrative of the present invention and is not to be construed as a limitation thereof, and various modifications of the present invention will be apparent to those skilled in the art. It is, therefore not, intended that the present invention be limited to the disclosed embodiments or details thereof, and the present invention includes all variations and/or alternatives embodiments within the spirit and scope of the present invention as defined by the appended claims.

What is claimed is:

1. A piston holder for a drive piston (8) of a setting tool, comprising two expansion legs (22, 23) for frictionally receiving the drive piston (8) therebetween; and carrier means (7) fixedly secured in the setting tool for supporting the two expansion legs (22, 23).

2. A piston holder according to claim 1, where in the expansion legs (22, 23) lie in a plane that forms, with a drive-out direction (17) of the drive piston (8) an acute angle ($\alpha$) opening toward a front end of the setting tool.

3. A piston holder according to claim 1, wherein the two expansion legs (22, 23) form legs of a V-shaped spring (18).

4. A piston holder according to claim 3, wherein the carrier means (7) includes a bolt (16), and wherein the V-shaped spring (18) has an end remote from the expansion legs (22, 23) and which is wound about the bolt (16).

* * * * *